United States Patent [19]

Apostolides

[11] Patent Number: 4,834,039

[45] Date of Patent: May 30, 1989

[54] MULTISTAGE PRE-LUBRICANT PUMP

[75] Inventor: John K. Apostolides, Pittsburgh, Pa.

[73] Assignee: R.P.M. Industries, Inc., Washington, Pa.

[21] Appl. No.: 218,949

[22] Filed: Jul. 13, 1988

[51] Int. Cl.[4] ..... F01M 1/00

[52] U.S. Cl. ..... 123/196 S; 123/179 A; 123/198 C

[58] Field of Search ..... 123/196 S, 196 R, 179 F, 123/179 A, 198 C

[56] References Cited

U.S. PATENT DOCUMENTS

| | | | |
|---|---|---|---|
| 4,199,950 | 4/1980 | Hakanson | 123/196 CP |
| 4,458,644 | 7/1984 | Papst | 123/196 S |
| 4,502,431 | 3/1985 | Lulich | 123/179 A |

*Primary Examiner*—E. Rollins Cross

*Attorney, Agent, or Firm*—Reed Smith Shaw & McClay

[57] ABSTRACT

The present invention pertains to a vehicle having an internal combustion engine. The internal combustion engine has a first plurality of movable parts which require lubrication during relative movement to reduce wear. The vehicle has N systems, each of which has a corresponding plurality of movable parts which require lubrication during relative movement of reduce wear. There is also an electrical mechanical starter mechanism for initiating movement within the engine. In addition there is a first oil supply system having a main engine oil pump which circulates oil to the first plurality of moveable parts and responds to movement within the engine. Also a supplemental engine oil pump communicates with the first oil supply system. The vehicle also has N oil supply systems. Each of the N oil supply systems have a corresponding main oil pump which circulates oil to the corresponding plurality of moveable parts in response to movement within the corresponding system. The improvement of the invention includes a device for activating the starter mechanism in the first mode of operation in which movement is not initiated within the engine and the N systems, and in a second mode of operation in which movement is initiated within said engine to effect combustion and in the N system to effect operation thereof. The improvement also includes N supplemental oil pumps.

6 Claims, 2 Drawing Sheets

MULTISTAGE PRE-LUBRICANT PUMP

FIELD OF THE INVENTION

The present invention relates to oil pump mechanisms for internal combustion engines. More specifically, the present invention relates to a multistage pre-lubricant oil pump mechanism for use in connection with a starter motor.

BACKGROUND OF THE INVENTION

The present invention is an improvement of U.S. Pat. No. 4,502,431.

In general, wherever there are moving parts which slide along a surface, friction is present therebetween. This friction between the moving parts and the surface they are sliding along causes wear and tear to both the surface and the moving parts. A common and simple practice to reduce the friction and thus the wear and tear between the moving parts and the corresponding surface is to provide lubricant there between.

In many situations, the lubricant must be continually provided to the moving parts and corresponding surface to reduce friction. For instance, upon ignition of an internal combustion engine, several seconds pass before oil is pumped throughout the engine to provide sufficient lubrication between any moving parts and corresponding surfaces and reduce friction. U.S. Pat. No. 4,502,431 or U.S. Pat. No. 4,553,512 provide a pre-combustion engine lubrication system or fluid pump assembly, respectively, which provides lubrication to internal combustion engines before ignition occurs therein. However, heretofore there has not been provided the ability to prelubricate secondary systems, such as additional engines or tertiary systems, such as transmissions, utilizing one starter motor.

SUMMARY OF THE INVENTION

The present invention pertains to a vehicle having an internal combustion engine. The internal combustion engine has a first plurality of movable parts which require lubrication during relative movement to reduce wear. The vehicle has N systems, each of which has a corresponding plurality of movable parts which require lubrication during relative movement to reduce wear. There is also an electrical mechanical starter mechanism for initiating movement within the engine. The starter mechanism has an armature shaft. In addition there is a first oil supply system having a main engine oil pump which circulates oil to the first plurality of moveable parts and responds to movement within the engine. Also a supplemental engine oil pump communicates with the first oil supply system. The supplemental engine oil pump system includes a rotatable drive shaft operably connected to the armature shaft of the starter mechanism to pump oil within the first oil supply system in response to at least a first mode of operation of the starter mechanism. The vehicle also has N oil supply systems. Each of the N oil supply systems have a corresponding main oil pump which circulates oil to the corresponding plurality of moveable parts in response to movement within the corresponding system. The improvement of the invention comprises means for activating the starter mechanism in the first mode of operation in which movement is not initiated within the engine and the N systems, and in a second mode of operation in which movement is initiated within said engine to effect combustion and in the N systems to effect operation thereof. The improvement also comprises N supplemental oil pumps. Each of the N supplemental oil pumps communicates with the corresponding oil supply system and include a rotatable drive shaft operably connected to the armature shaft of the starter mechanism to pump oil within the corresponding oil system in response to at leat a first mode of operation of the starter mechanism.

DESCRIPTION OF PREFERRED EMBODIMENT

Figure 1:
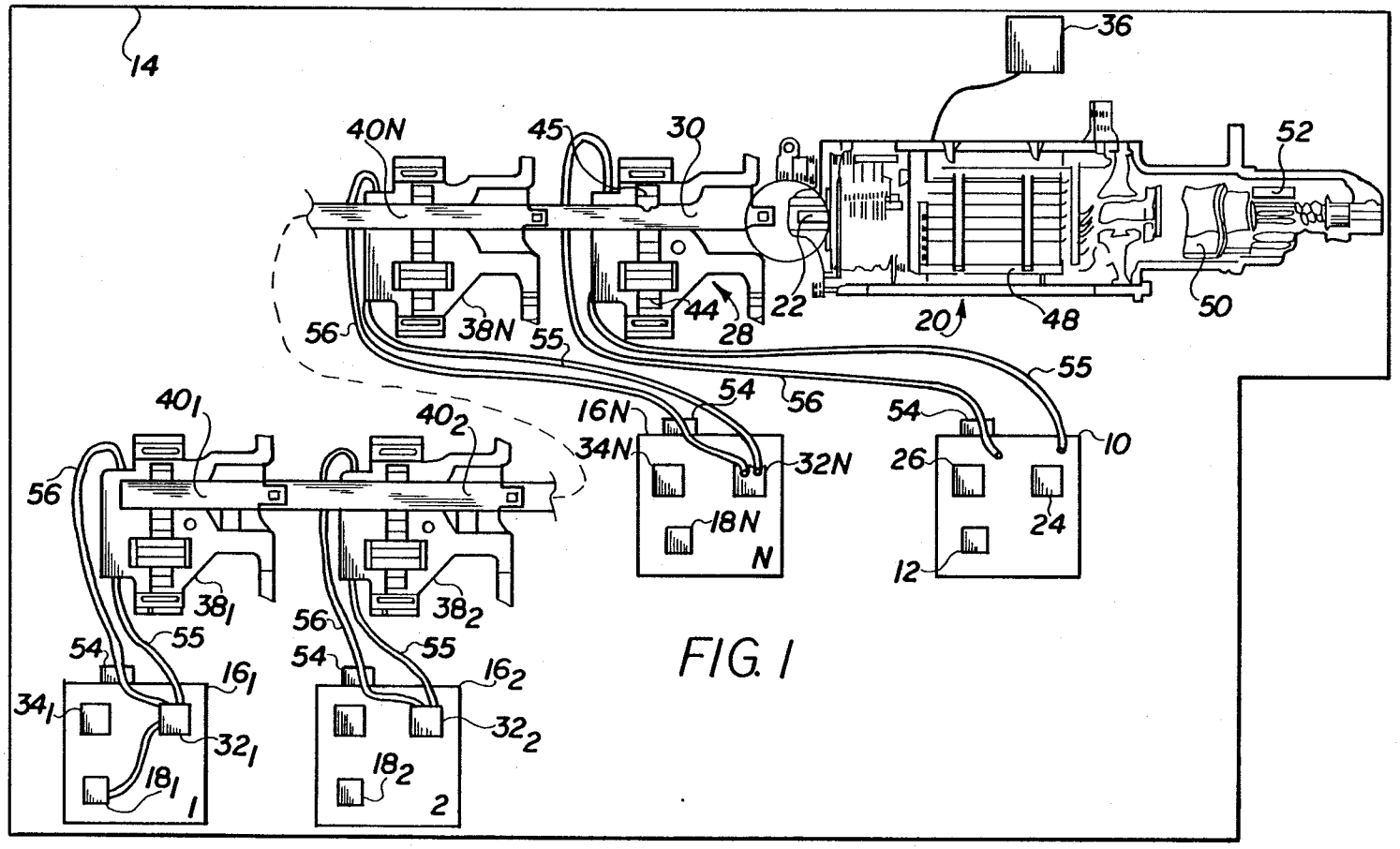
FIG. 1 is a partial schematic representation of a starter and multi-prelubricant oil pump mechanism.

Referring now to FIG. 1, which is a partial schematic representation of the present invention, there is shown an internal combustion engine 10. The internal combustion engine 10 has a first plurality of movable parts 12 which require lubrication during relative movement to reduce wear. The internal combustion engine 10 is located in a vehicle 14. The vehicle 14 has N systems $\mathbf{16}_1$ through $\mathbf{16}_N$, each of which has a corresponding plurality of movable parts $\mathbf{18}_1$ through $\mathbf{18}_N$ which require lubrication during relative movement to reduce wear. There is also an electrical mechanical starter mechanism 20 for initiating movement within the engine 14. The starter mechanism 20 has an armature shaft 22.

In addition, there is a first oil supply system 24 having a main engine oil pump 26 which circulates oil to the first plurality of movable parts 12 and responds to movement within the internal combustion engine 10. Also a supplemental engine oil pump 28 communicates with the first oil supply system 24. The supplemental engine oil pump system 28 includes a rotatable drive shaft 30 operably connected to the armature shaft 22 of the starter mechanism 20 to pump oil within the first oil supply system 24 in response to at least the first mode of operation of the starter mechanism 20.

The vehicle also has N oil supply systems $\mathbf{32}_1$ through $\mathbf{32}_N$. Each of the N oil supply systems $\mathbf{32}_1$ through $\mathbf{32}_N$ has a corresponding main oil pump $\mathbf{34}_1$ through $\mathbf{34}_N$ which circulates oil to the corresponding plurality of movable parts $\mathbf{18}_1$ through $\mathbf{18}_N$, respectively, in respone to movement within the corresponding system $\mathbf{16}_1$ through $\mathbf{16}_N$, respectively.

The improvement of the invention comprises means 36 for activating the starter mechanism 20 in the first mode of operation in which movement is not initiated within the engine 14 and the N system $\mathbf{16}_1$ through $\mathbf{16}_N$ to effect operation thereof. The improvement also comprises N supplemental oil pumps $\mathbf{38}_1$ through $\mathbf{38}_N$, respectively. Each of the N supplemental oil pumps $\mathbf{38}_1$ through $\mathbf{38}_N$ communicates with the corresponding oil supply system $\mathbf{32}_1$ through $\mathbf{32}_N$, and include a rotatable drive shaft $\mathbf{40}_1$ through $\mathbf{40}_N$ operably connected to the armature shaft 22 of the starter mechanism 20 to pump oil within the corresponding oil systems $\mathbf{32}_1$ through $\mathbf{32}_N$ in response to at least a first mode of operation of the starter mechanism 20. Preferably, each rotatable drive shaft $\mathbf{40}_1$ through $\mathbf{40}_N$ is connected in series to the rotatable drive shaft $\mathbf{40}_i$ which is in turn connected to another rotatable drive shaft of another supplemental oil pump. With each rotatable drive shaft in each supplemental oil pump being connected to another rotatable drive shaft of another supplemental oil pump, each rotatable drive shaft is operably connected to the armature shaft 22 of the starter mechanism 20. This is because the first supplemental engine oil pump 28 and its rotatable drive shaft 30 is connected to the armature shaft 22 of the starter mechanism 20 and there is the supplemental oil pump $34_N$ with its rotatable drive shaft $40_N$ connected to the rotatable drive shaft 30 of the supplemental engine oil pump 28. Alternatively, there can be a single drive shaft 40 which communicates with each supplemental oil pump $38_1$ through 38N.

Figure 2:
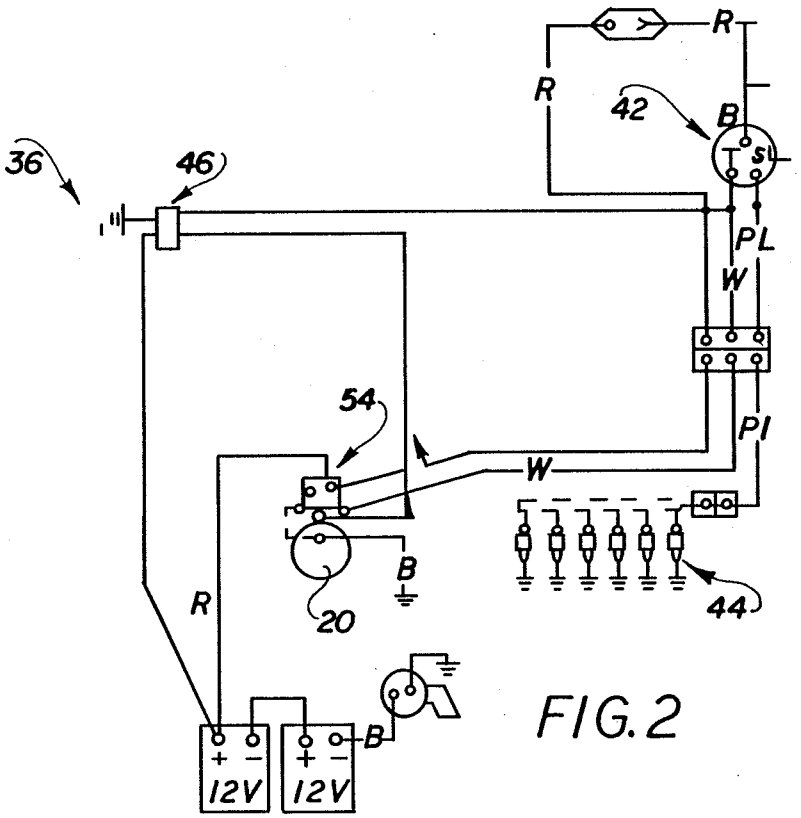
FIG. 2 is a schematic diagram of an electrical system.

The activating means 37 can be an electrical system as shown in FIG. 2. FIG. 2 is more completely described in U.S. Pat. No. 4,502,431, which is incorporated herein by reference. (Note the starter mechanism 20 is also more fully described in U.S. Pat. No. 4,502,431.) Briefly, and referring to FIG. 2, a three position starter switch assembly 42 has an off position, a start position, and a cranking position. The off position renders the electrical system of the engine 14 inoperative. In the start position, glow plugs 44 are activated with 24 volts of electrical energy to provide heat to the engine's 14 cylinders, and subsequently to electrically energize the starter mechanism 20. Particularly, a second solenoid 46 energizes an electrical motor 48 of starter mechanism 20 when the switch assembly 42 is in the start position, but does not energize a drive mechanism 50 to engage a starter gear 52 with, for instance, a fly wheel (not shown) of the engine 14. Through this arrangement, the armature 22 of the starter mechanism 20 may be driven to rotate the rotatable drive shaft 30 of the first supplemental oil pump 28 and the rotatable drive shafts $40_1$ through $40_N$ of the N supplemental oil pumps $38_1$ through $38_N$ to initiate pumping of oil therethrough, prior to the cranking of the engine. The first supplemental oil pump 28 and the N supplemental oil pumps $38_1$ through $38_N$ remain energized during the entire period and are able to achieve normal operating oil pressures throughout the engine and N systems $16_1$ to $16_N$ prior to combustion, thereby assuring that the first plurality of movable parts 12 and N plurality of moving parts $18_1$ through $18_N$ in the systems $16_1$ through $16_N$ are lubricated during their initial cyclings.

Preferably, the switch assembly 42 does not move to its cranking position until each of the N systems $16_1$ through $16_N$ are at a desired oil pressure. This can be accomplished by either determining the longest period of time it takes for any one of the N systems $16_1$ through $16_N$ to attain a desired oil pressure, and placing a delay at least of that time period in the electricl system 36. Alternatively, this can be accomplished by placing sensors that relay a signal in each of the N systmes $16_1$ through $16_N$ and only after each sensor has been triggered due to the associated system attaining a desired oil pressure does another switch (not shown) engage, allowing the starter switch assembly 42 to disengage the second solenid 46.

The supplemental engine oil pump 28 and N supplemental oil pumps $38_1$ through $38_N$ draw oil from the corresponding oil supplies through oil intake line 55 and pump oil back into the engine 10 and N systems $16_1$ through $16_N$ through outlet line 56. The inlet line 55 and outlet line 56 are so disposed with respect to their corresponding engine or system such that they do not interfere with the existing main engine oil pump 26 or main oil pumps $34_1$ through $34_N$. U.S. Pat. No. 4,502,431 more fully describes this relationship with respect to the first supplemental engine oil pump 28, the main engine oil pump 26 and the engine 10. The description found in U.S. Pat. No. 4,502,431 can be expanded to apply to the N supplemental engine oil pumps $40_1$ through $40_N$ and the corresponding main oil pumps $34_1$ with respect to the N systems $16_1$ through $16_N$. The above discussion is also applicable to U.S. Pat. No. 4,553,512, wherein the armature shaft 22 is connected to the shaft extension described in U.S. Pat. No. 4,553,512.

Preferably, a check valve 54 is mounted on the engine 14 and N systems $16_1$ through $16_N$ in the corresponding outlet line 56 to prevent oil backflow while the first supplemental engine oil pump 28 and N supplemental oil pumps $38_1$ through $38_N$ are inoperative, to prevent oil flow from spinning starter mechanism 20 during normal engine operation.

Consequently, a single starter mechanism 20 can be used to operate N supplemental oil pumps $38_1$ through $38_N$, for instance, in a vehicle, besides providing prelubrication to the internal combustion engine. The N systems can be a transmission system or a compressor, or, in a boat, two internal combustion engines as well as any ancillary systems thereto from the starter mechanism 20. Accordingly, the present invention is not intended to be limited in scope by the description of the preferred embodiment provided above, but rather, only by the claims which follow.

What is claimed is:

1. In a vehicle having an internal combustion engine having a first plurality of moveable parts which require lubrication during relative movement to reduce wear;

N systems each having a corresponding plurality of moveable parts which require lubrication during relative movement to reduce wear;

an electromechanical starter mechanism for initiating movement within said engine and having an armature shaft;

a first oil supply system having a main engine oil pump which circulates oil to said first plurality of moveable parts in response to movement within said engine;

a supplemetal engine oil pump communicating with the first oil supply system and including a rotatable drive shaft operatively connected to said armature shaft of the starter mechanism to pump oil within said first oil supply system in response to at least a first mode of operation of said starter mechanism;

N oil supply systems each having a corresponding main oil pump which circulates oil to said corresponding plurality of moveable parts in response to movement within said corresponding system;

the improvement comprising:

means for activating said starter mechanism in the first mode of operation in which movement is not initiated within said engine and said N systems and in a second mode of operation in which movement is initiated within said engine to effect combustion and in said N systems to effect operation thereof; and N supplemental oil pumps, each of said N supplemental oil pump communicating with the corresponding oil supply system and including a rotatable drive shaft operatively connected to said armature shaft of the starter mechanism to pump oil within the corresponding oil supply system in response to at least the first mode of operation of said starter mechanism.

2. The vehicle as set forth in claim 1, further comprising:

switching means for engaging said first mode of starter mechanism operation for a controllable time period prior to engagement of said second mode of starter mechanism operation, to generate oil pressure in said engine and said N systems prior to initiating movement of said first and each of said N plurality of movable parts therein.

3. The vehicle as set forth in claim 2, wherein said supplemental engine oil pump and said N supplemental oil pump pumps oil in response to both said first and second modes of operation of said starter mechanism, wherein said main engine oil pump and said N main oil pumps pump oil in response to said second mode of operation, and wherein said controllable time period is of a sufficient duration such that normal operating oil pressures are achieved in said engine and said N systems during said first mode of operation.

4. The vehicle as set forth in claim 3, further comprising means for automatically terminating said second mode of starter mechanism operation upon combustion in said engine, whereby said supplemental engine oil pump and N supplemental oil pumps become inoperative.

5. The vehicle as set forth in claim 4, further comprising N+1 oil check valve means for isolating said supplemental engine oil pump and N supplemental oil pumps from said engine oil supply system and N oil supply system, respectively, when said supplemental engine oil pump and said N supplemental oil pumps are inoperative.

6. In a vehicle having an internal combustion engine having a first plurality of moveable parts which require lubrication during relative movement to reduce wear;

N systems each having a corresponding plurality of moveable parts which require lubrication during relative movement to reduce wear;

an electromechanical starter mechanism for initiating movement within said engine and having an armature shaft;

a first oil supply system having a main engine oil pump which circulates oil to said first plurality of moveable parts in response to movement within said engine;

a supplemental engine oil pump communicating with the first oil supply system and including a rotatable drive shaft operatively connected to said armature shaft of the starter mechanism to pump oil within said first oil supply system in response to at least a first mode of operation of said starter mechanism;

N oil supply systems each having a corresponding main oil pump which circulates oil to said corresponding plurality of moveable parts in response to movement within said corresponding system;

the improvement comprising:

means for activating said starter mechanism in the first mode of operation in which movement is not initiated within said engine and said N systems and in a second mode of operation in which movement is initiated with said engine to effect combustion and in said N systems to effect operation thereof; and N supplemental oil pumps, each of said N supplemental oil pump communicating with the corresponding oil supply system and contacting the rotatable drive shaft extending from and operatively connected to said armature shaft of the starter mechanism to pump oil within the corresponding oil supply system in response to at least the first mode of operation of said starter mechanism.

* * * * *